US005653092A

United States Patent [19]

Gorby et al.

[11] Patent Number: 5,653,092

[45] Date of Patent: Aug. 5, 1997

[54] FILLING DEVICE FOR FOOD CANS

[75] Inventors: Jack Gorby, Los Angeles; Edward J. Rowley, Azusa, both of Calif.

[73] Assignee: Luthi Machinery & Engineering Co., Inc., Gardena, Calif.

[21] Appl. No.: 544,790

[22] Filed: Oct. 6, 1995

[51] Int. Cl.[6] ..... B65B 1/24

[52] U.S. Cl. ..... 53/438; 100/178; 53/529

[58] Field of Search ..... 53/529, 438; 141/114, 141/313, 314, 315, 316, 317; 100/178, 223, 244, 264

[56] References Cited

U.S. PATENT DOCUMENTS

| | | | |
|---|---|---|---|
| 2,567,052 | 9/1951 | Carruthers | 100/178 |
| 3,406,727 | 10/1968 | Rexus | 53/253 |
| 3,750,225 | 8/1973 | Gould et al. | 15/182 |
| 4,150,520 | 4/1979 | Palmieri et al. | 53/247 |
| 4,192,359 | 3/1980 | Pippin | 141/12 |
| 4,757,757 | 7/1988 | Johanson | 100/264 |
| 4,804,550 | 2/1989 | Bardsley et al. | 141/12 |
| 4,899,867 | 2/1990 | Ryan | 141/114 |
| 5,320,146 | 6/1994 | Stevie | 141/114 |

*Primary Examiner*—Linda Johnson
*Assistant Examiner*—John Paradiso
*Attorney, Agent, or Firm*—Phillips, Moore, Lempio & Finley

[57] ABSTRACT

This invention relates to a machine to ensure that the amount of food product in a can meets the volume and weight standards without altering the natural characteristics of the product necessary for the market. The invention encompasses a combination of scrapers or sweepers and a primary pocket turret assembly and including a rotating cylinder body having sweeper blades positioned thereon in a helical form so the amount of food product in associated cavities in the rotating table meets weight, volume, and product appearance standards. In addition, pneumatic cylinders and cam-driven cylinders from below compress the product in the device prior to the final leveling accomplished by the rotating helical sweepers.

8 Claims, 7 Drawing Sheets

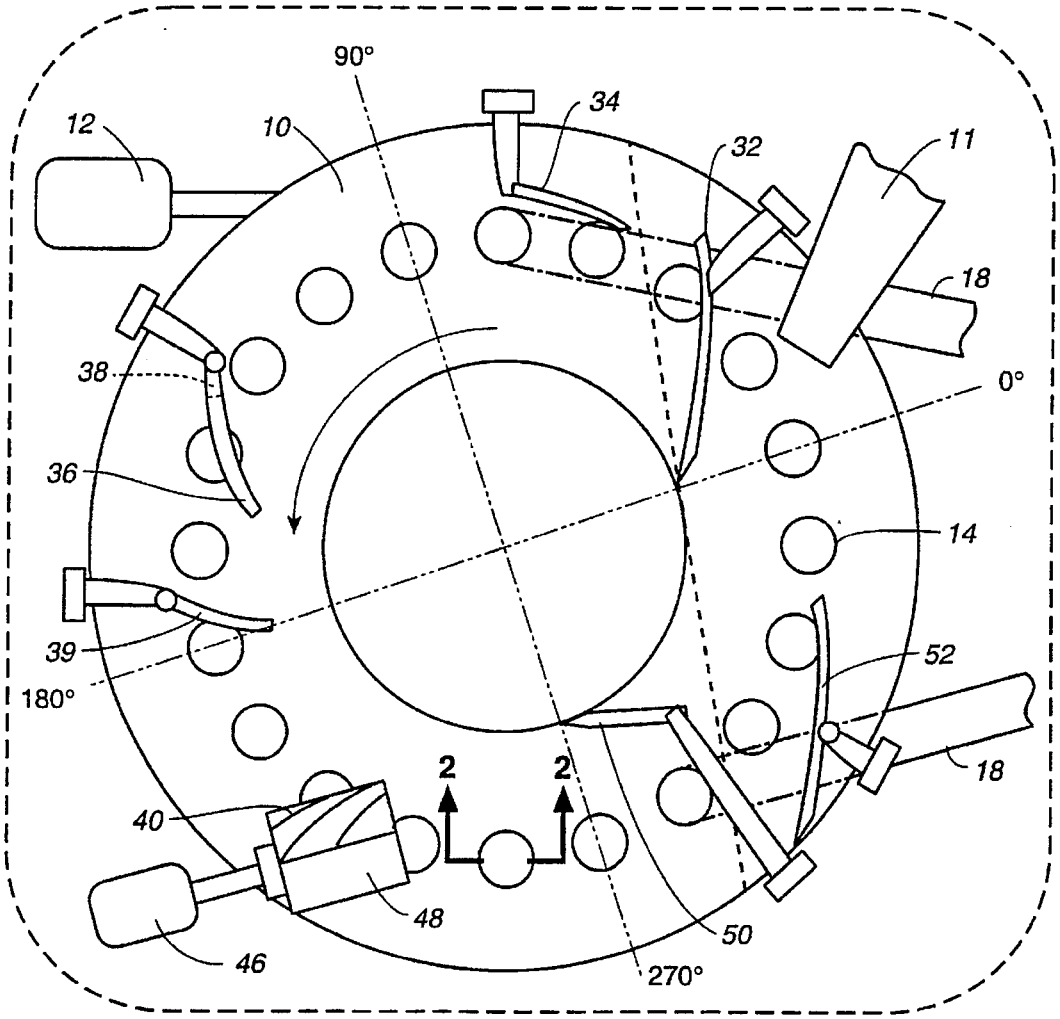
FIG._1
FIG._5
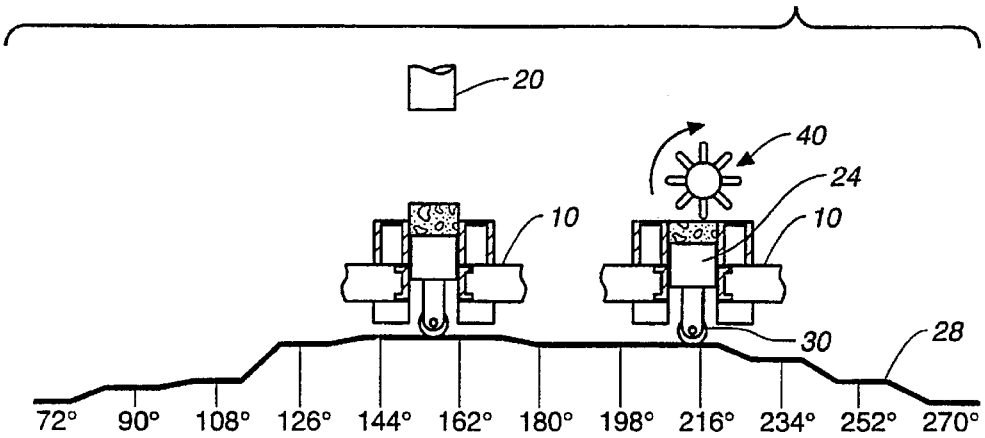

FIG._6
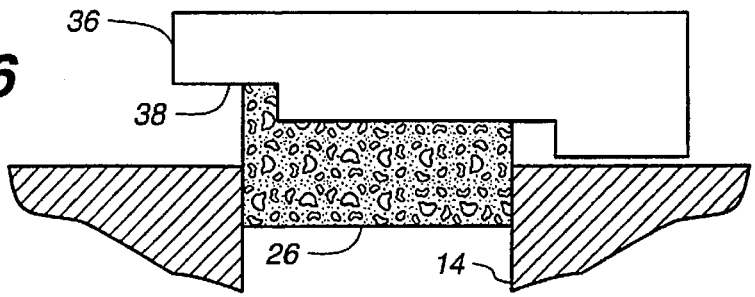
FIG._6A
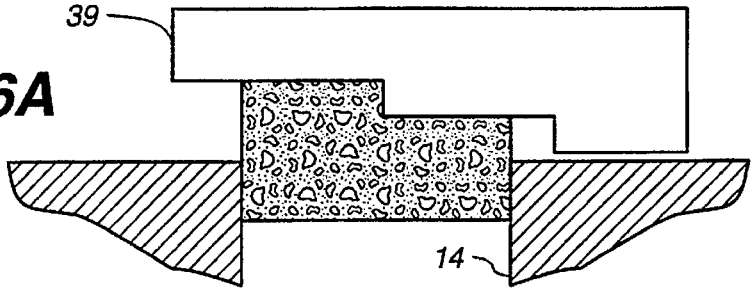
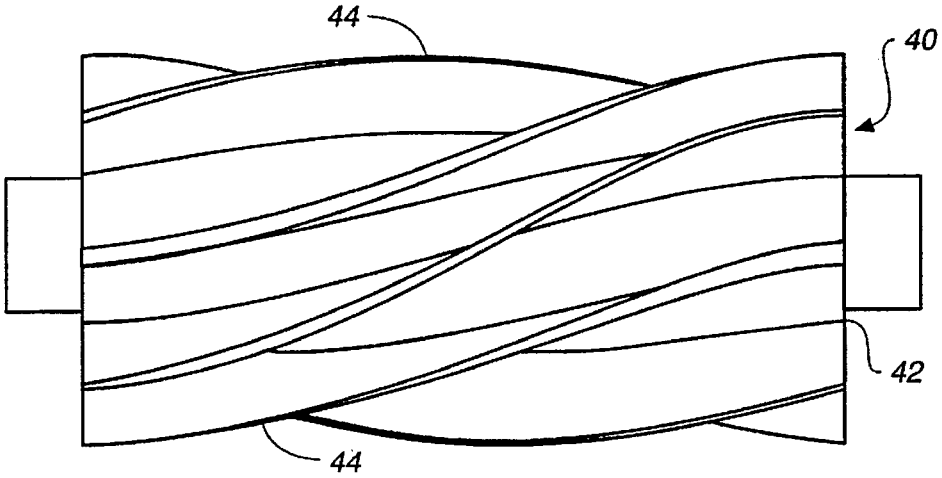
FIG._7
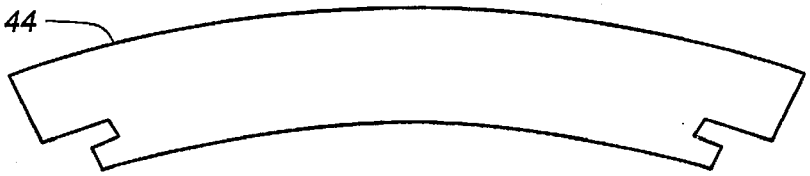
FIG._8

FILLING DEVICE FOR FOOD CANS

BACKGROUND OF THE INVENTION

In the food processing business, the step of apportioning a food product to individual containers such as cans requires some means of measuring the product so that the final amount to be delivered to the can meets the weight and volume standards of the canner. It would be appropriate if one could weigh the product as is passes a weighing station before it is placed in the can. However, the necessities of the canning business are such that an individual weight of a product is simply not a practical course of action.

Accordingly, machines are in the market now that include a circular turntable or turret assembly having a plurality of holes or cavities generally equal in diameter to the can size. Food is placed in a tray on this turret assembly turntable and urged into the cavity by means of various sweepers. In situations where the food is in a flake-like form, such as seafood or meat, a certain amount of crushing or cutting of the food is acceptable. In these instances, the food can be packed into the cavity and at the final stage, knives used to cut off the food equal to the size of the container. Then, the food is forced into a cup-like structure which in turn conveys the food to the open can.

In the vegetable canning industry, the method utilized in the meat-packing industry is not acceptable as the ultimate user, i.e., the customer, is most desirous of getting whole food. For example, lima beans should not be damaged in the canning process. Using knives to ensure that the can cavity is full and up to the weight standard is not an acceptable method, and therefore, a substitute has to be found.

Presently, the food canning industry uses a rotating brush having numerous fingers extending outwardly therefrom to massage the vegetables in the cavity and thus, in effect, jiggle the vegetables down so that an adequate amount of vegetables are provided to meet the weight standard.

The problem with the rotating brush having numerous fingers extending therefrom is that the brush picks up food particles and eventually becomes fairly well saturated with either whole pieces of beans or whatever is being packed. When this occurs, the machine has to be stopped and the brush cleared before the product can continue to be placed in the cavities.

As noted above, the sweepers to direct the food into the cavity of the primary pocket turret assembly or rotating table to effectively ensure that the cavity is full. However, sweepers per se are ineffective in leveling the top of the can. This invention overcomes the problem associated with the brushes used to fill the can, and overcomes the problem associated with the sweepers damaging the food.

It is therefore an object of this invention to provide a canning machine which locates the metered amount of food product in the canning cavity with minimal damage.

It is a further object of this invention to ensure that the canning system does not unduly clog the various members that fill the cans.

It is still a further object of this invention to provide a scheme such that the excess food in the rotating can cavity table is directed toward the center of the rotating table as the can cavity is opened to the cup below.

Generally stated, this invention encompasses a metering and packing system for a food canning machine. The food canning machine includes a primary pocket turret assembly which includes a horizontally-mounted and rotatable turntable having a plurality of cylindrical pockets and a plurality of cups, the pockets and the cups are rotatable with said turntable. Each pocket has an opening at both the top and the bottom, and communicates with the cup below the pocket and is axially aligned therewith. The system comprises a plurality of compression pistons and a plurality of metering pistons. The compression pistons mounted above the table are movable inwardly and outwardly of the pockets, while the metering pistons mounted below the table are movable through the cups and at least into the pockets. Feed means are included for introducing food to the turntable. A first sweeper means directs food on the turntable into the pockets, while a helical sweeper means moves the food across the top opening thereof. Further included are means to move the compression piston and the metering piston toward and away from each other, whereby the food contained in the pocket is compressed. Means are included to move the compression piston upwardly and outwardly of the pocket, and to move the metering piston into said pocket through the lower end thereof so that the compressed food moves outwardly through the top opening of the pocket. Finally, drive means are included to operate the helical sweeper after the metering piston moves the food outwardly through the top opening of the pocket.

BRIEF DESCRIPTION OF THE DRAWINGS

FIG. 1 is a schematic top view of the primary pocket turret assembly or rotating table of the metering and packing system.

FIG. 5 is a diagram of the same cam shown in FIG. 4 in a two-dimensional arrangement.

FIG. 6 is a cross-section of one of the sweepers.

FIG. 6A is a cross-section of one of the sweepers.

FIG. 7 is a side view of the helical sweeper.

FIG. 8 is a view of one of the sweepers that forms the helical sweeper shown in FIG. 7.

DETAILED DESCRIPTION OF THE PREFERRED EMBODIMENT

Figure 2:
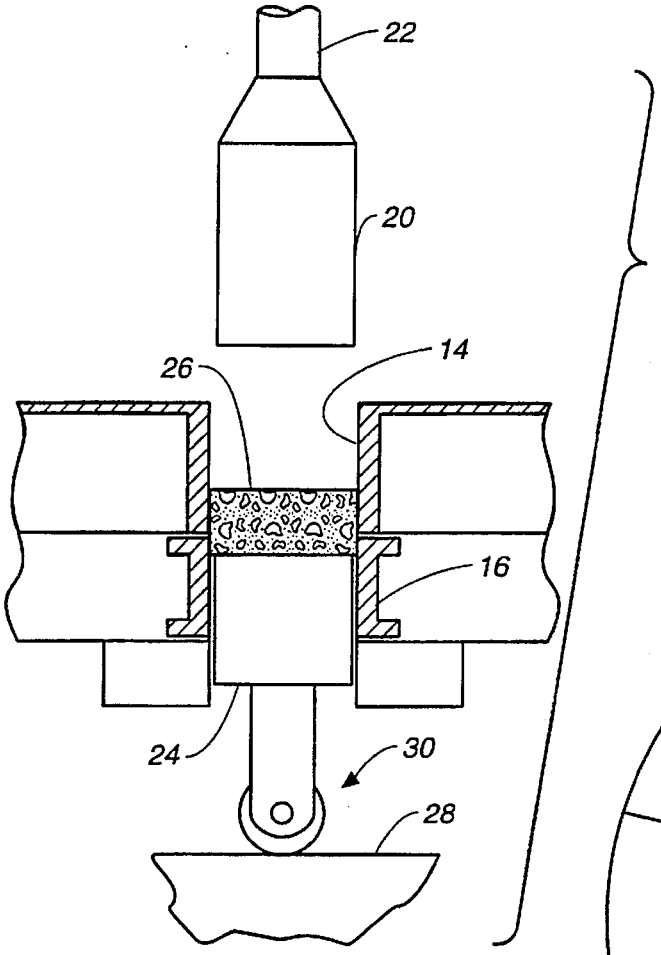
FIG. 2 is a cross-section of one of the pockets and cups of the metering and packing system, shown at section line 2—2 of FIG. 1.

This invention is a modification of a tuna packing machine manufactured by Luthi Machinery & Engineering Co., Inc., in Gardena, Calif. The machine differs from the tuna packing machine in that the tuna packing machine utilizes knives to cut the product off to ensure that it will fit into the can with the proper weight and volume of the product.

Accordingly, the description that follows is with reference to the Luthi tuna packing machine, and the differences between the tuna packing machine and the present vegetable packing machine will be covered in detail.

Referring to FIG. 1, a primary pocket turret assembly or rotating table 10 is shown. The table 10 is a portion of the vegetable packing machine that forms the invention herein.

The power provided to rotate the table 10 comes from a motor 12 shown schematically in FIG. 1. Table 10 includes a plurality of openings or pockets 14. Each pocket 14 is substantially of the same diameter of the can that is to be filled with the food. Each pocket 14, however, has a depth greater than the depth of the can, so that a sufficient amount of food can be incorporated into the pocket for eventual insertion into the can.

Located below each pocket 14 and rotating therewith is a series of cups 16 which are pushed through the bridge structure 18 in an independent fashion along with rotating table 10. This structure 18, as can be seen in FIG. 1, departs the circular rotation of the rotating table so that the cup 16 can be transported to the can filling mechanism (not shown). Located above rotating table 10 is a plurality of compression pistons 20. There are an equal number of compression pistons 20 to the pockets 14. The compression pistons 20 rotate along with the rotating table 10 and thus each is axially aligned with a corresponding pocket 14. Compression pistons 20 are preferably operated by pneumatic 22 means to avoid any possibility of contamination that could occur if a liquid type operating system were provided.

A conveyor 11 or other appropriate means provides food product to table 10 at a point where the cups have returned to the turntable.

Located below rotating table 10 and in like manner and equal to the number to pockets 14 are metering pistons 24. Again, it is to be understood that each associated pocket has a metering piston 24 located with and rotating with the rotating table 10, just as each pocket has an associated compression piston. The metering piston 24 is adapted to move upwardly through cup 16 and into pocket 14, as shown in FIG. 2. In like manner, compression piston 20 is adapted to move downwardly into the pocket 14 as best shown at about the 108° position shown in FIG. 3. At the same time, metering piston 24 has moved upwardly so that the food product 26 is gently compressed to approximately the volume of the can to be filled.

Figure 4:
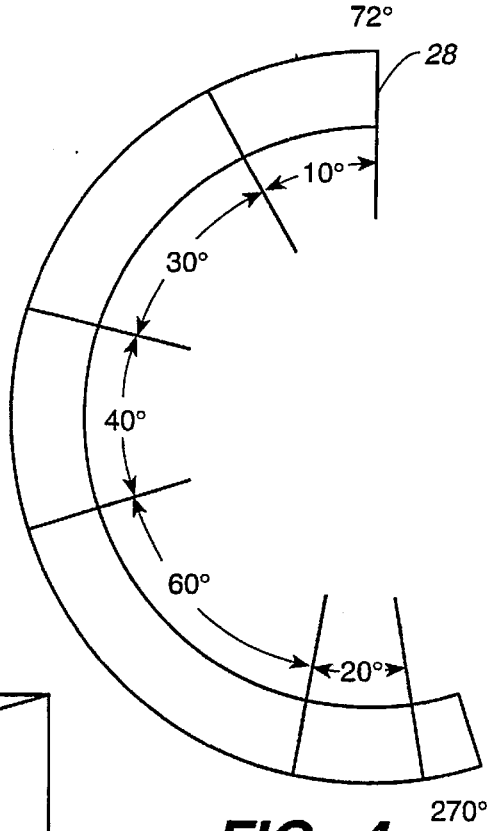
FIG. 4 is a diagram of a cam which operates the metering pistons.

The upward movement of metering piston 24 is accomplished by means of a cam 28 shown in FIGS. 4 and 5. The piston 24 has extending downwardly a cam follower mechanism 30 which moves along the cam 28 by rotation of the turret assembly and table 10. It is to be understood that cam 28 is stationary relative to the rotating table 10 so that the cam profile shown in FIG. 5 is operative on the cam followers 30 to cause the metering piston 24 to move upwardly through the cup 16 and into the pocket 14 as the turret assembly table 10 and associated pistons rotate.

Located above rotating table 10 are a series of sweepers to direct food product into the vicinity of the pockets 14. Specifically, a first sweeper 32 is located after the position where the food is introduced to the rotating table 10. This is followed by a second sweeper 34 located just past the first sweeper 32. It is to be understood that food is introduced prior to the first sweeper 32, with the table 10 rotating in a counterclockwise direction. The sweepers, of course, are stationary relative to the table, and are affixed to the underlying machine structure.

As the food and table rotate through approximately the next 90°, the food meets a primary or third sweeper 36. Third sweeper 36, along with the next or fourth sweeper 39, serve a special purpose. Sweeper 36 is shown in cross-section in FIG. 6. Sweeper 39 is of a similar configuration, as shown in cross-section in FIG. 6A. Third sweeper 36 has at one end, namely, the end adjacent the outer circumference of rotating table 10, a cutout 38 so that food product 26, while being leveled off across approximately one-half to three-quarters of the diameter of the pocket 14, food is left with a "high" side on the outer perimeter of the outside of the pocket 14. More will be said about this in the discussion of the continuing mechanism of the machine that follows.

Figure 9:
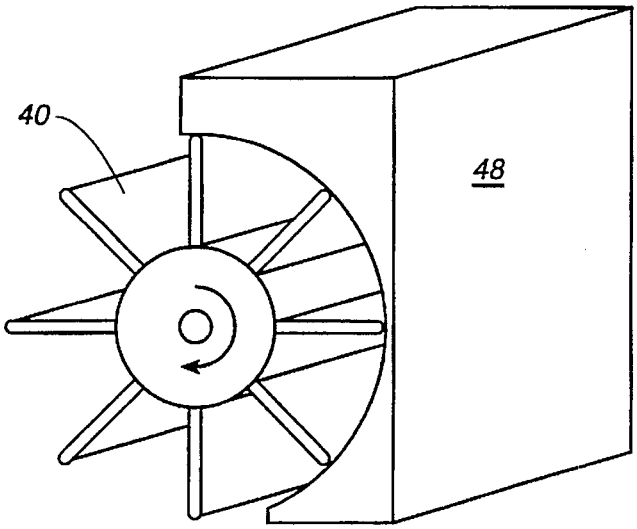
FIG. 9 is a perspective view of the sweeper shown in FIG. 7, along with the deflector associated therewith.
Figure 3A:
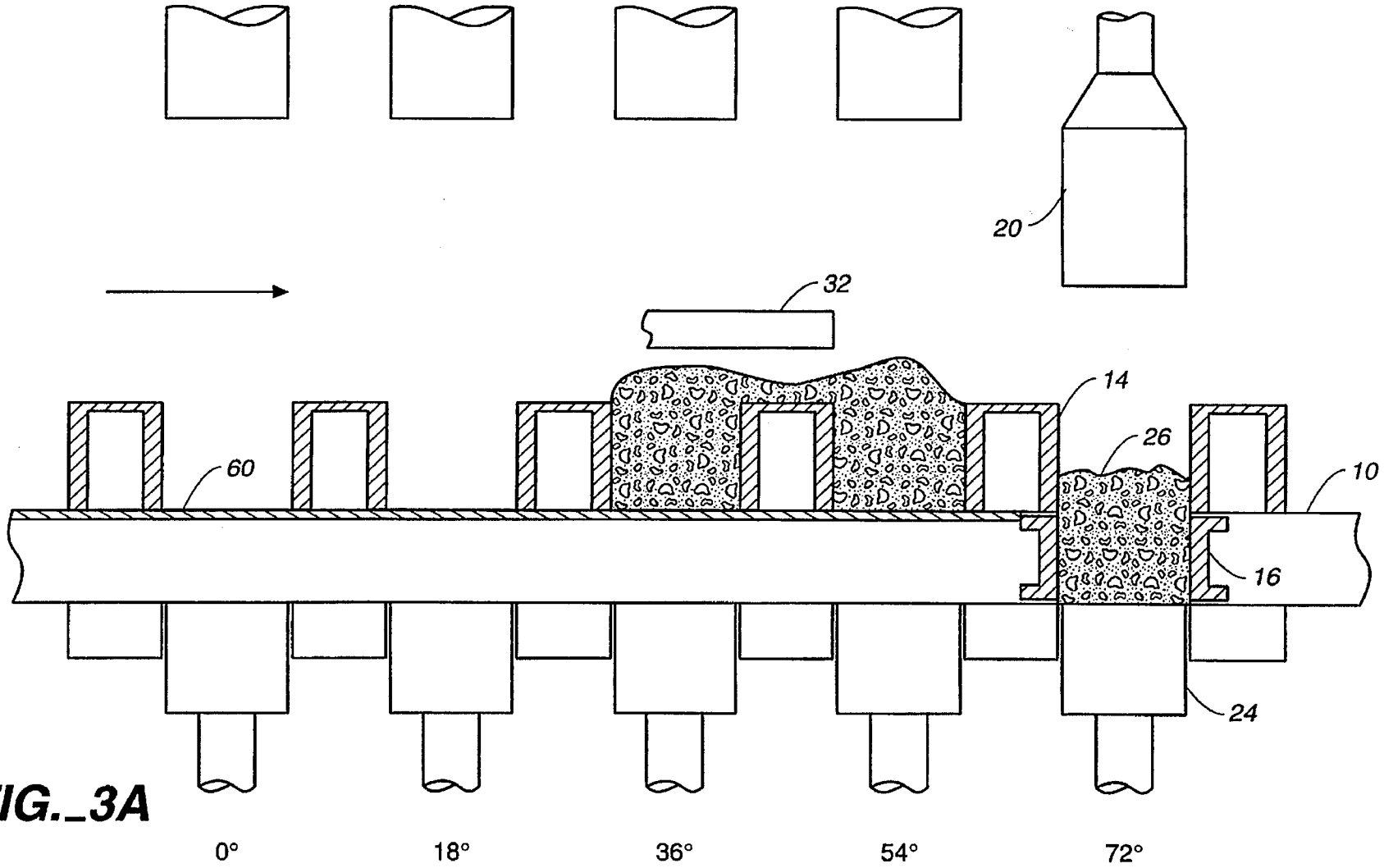
FIGS 3A–3D is a series of schematic views showing the positioning of the compression pistons and the metering pistons in relation to the pockets and cups at selected rotational positions.
Figure 3B:
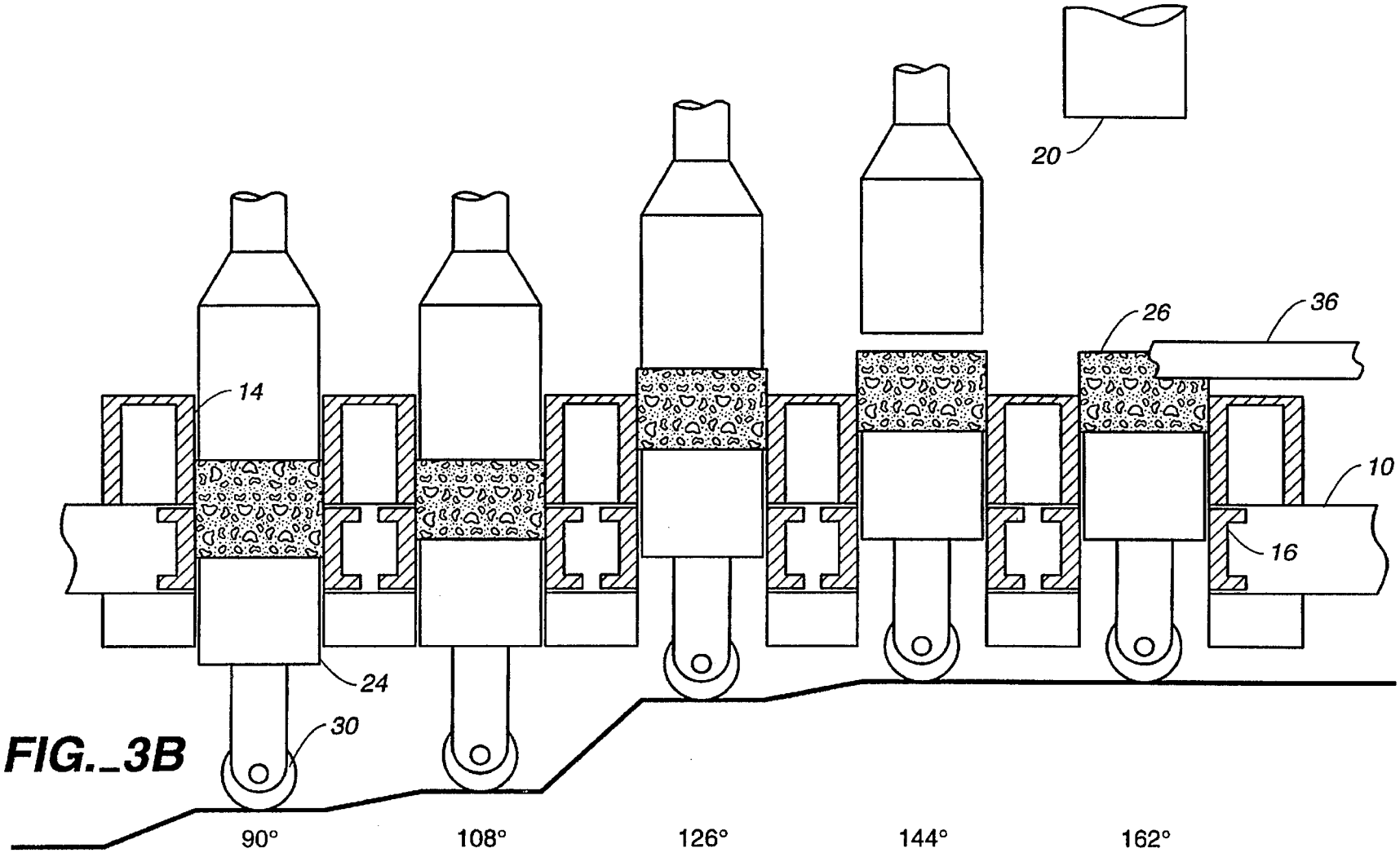
Figure 3C:
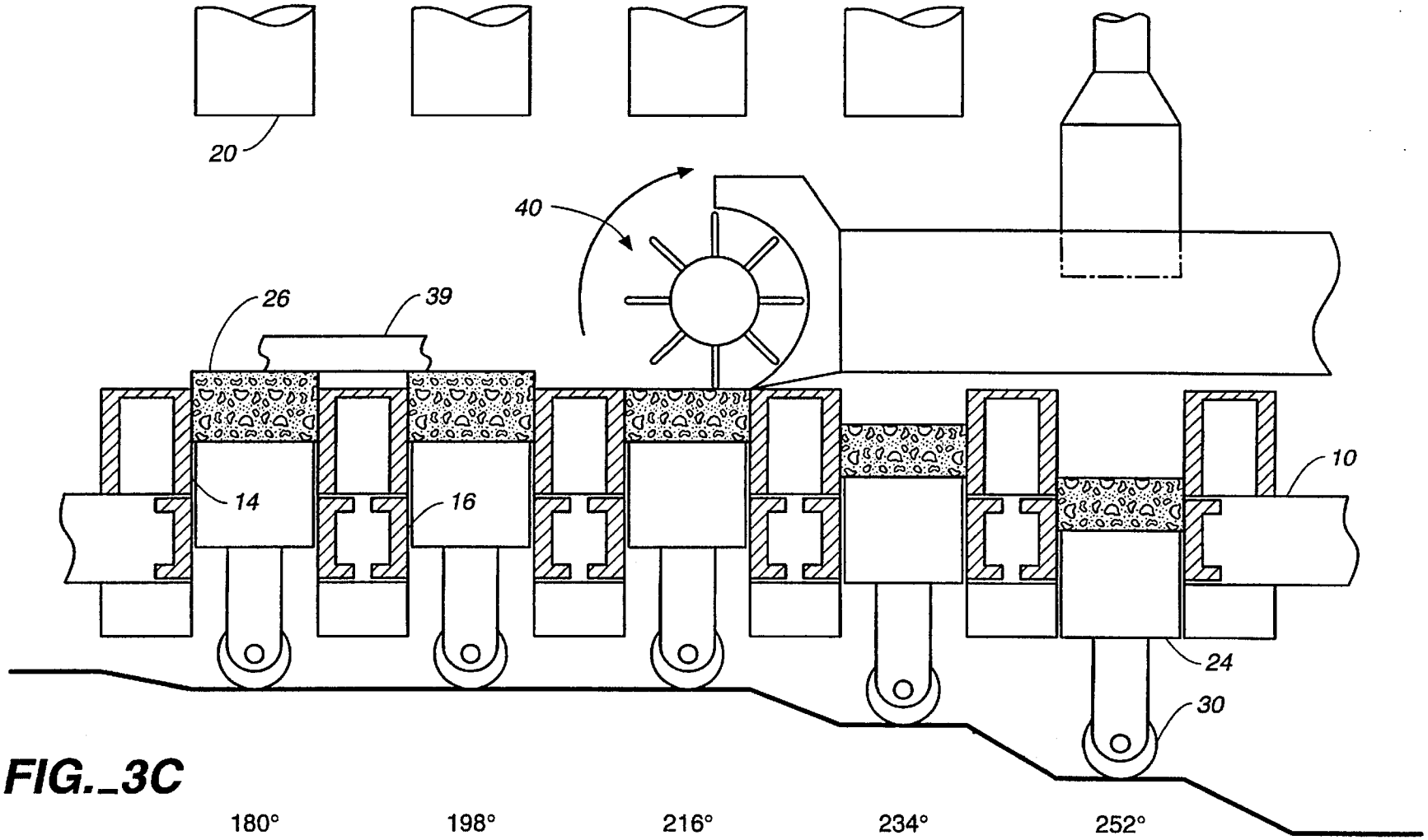
Figure 3D:
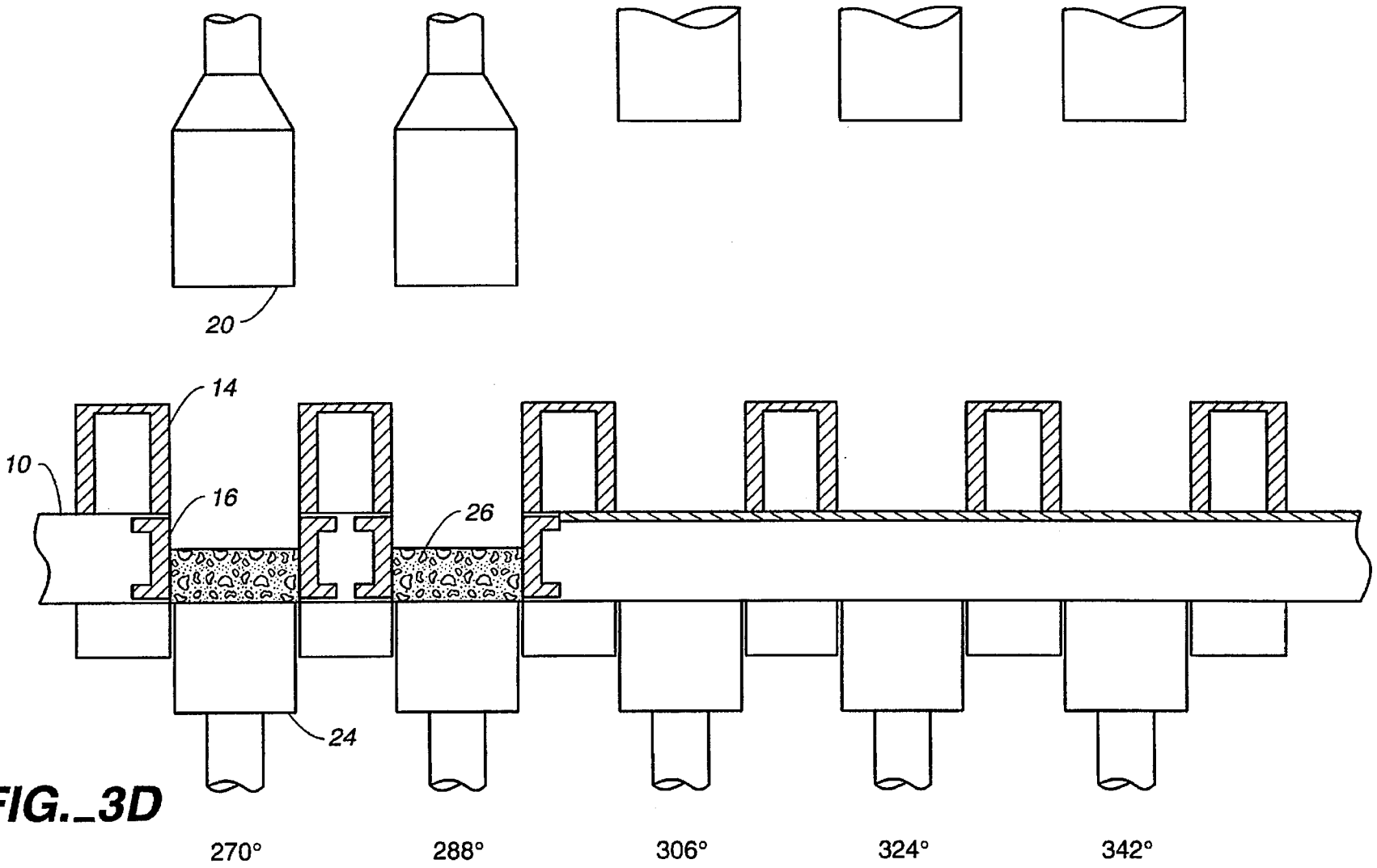

A fourth sweeper 39, which also has a cut-out portion in the manner of third sweeper 36, further adjusts the top of the food 26 as it passes into the final food leveling mechanism shown in FIG. 1. This final mechanism is a helical sweeper 40, best shown in FIG. 7. Helical sweeper 40 consists of a cylinder body 42 having a series of helical grooves thereabout. Positioned in each groove is a sweeper-type device 44, shown in FIG. 8. Each sweeper blade 44 is positioned in the cylinder body 42 so as to form a pattern similar to the pattern of the blades of a reel lawn mower. Each sweeper blade 44 is located so that it covers 90° in the helical pattern from one end of cylinder body 42 to the other end. Helical sweeper is driven by a motor 46 in a direction such that the sweeper blades 44 will sweep across the top of the can in a direction opposite of the rotation of table 10, thereby pushing the food product toward the center of rotating table 10. In conjunction with the sweeping mechanism of the blades, a deflector mechanism best shown in FIG. 9, is utilized in conjunction with the helical sweeper 40 so that any food particles picked up by the helical sweeper 40 and carried around in its rotation are caused to be moved outwardly toward the deflector 48 by an auger-type motion and delivered back to the rotating table 10 beyond the range of the helical sweeper 40. Thus, food product is delivered toward the center of the table after the table passes under the helical sweeper assembly There exist two additional sweepers, sweeper 50 and sweeper 52, which tend to accumulate the food product not deflected into the pockets or surplus to the pockets back toward the position where additional food is added to the machine.

Referring to FIG. 3, a diagram of the positioning of the compression pistons 20 and the metering pistons 24 is shown. For purposes of understanding, this drawing can be considered to be the 20 holes of the rotating table 10 of the primary pocket turret assembly located at their respective positions, or alternatively, it can be considered as a single hole as it passes through the 360° rotation cycle of the table 10. As noted, the food is delivered to and positioned on the table at about the 45°–60° position, as shown in FIG. 1, with the third sweeper 36 located at about the 145° position. At the point where the food is introduced to the rotating table 10, the compression pistons 20 are in their fully upward position. At that point, the cups located below the structure are just coming into play underneath the individual pockets 14. A plate 60 is arranged so that food is not dropped through the pocket after the cups pass along cup conveyer 18 to the can filler section (not shown). At the 90° point, the metering piston 24 has been moved up into the cup 16 and the compression piston 20 has been brought down into the vicinity of pocket 14. At the 108° position, compression begins with piston 20 and piston 24 essentially compressing the food then in the pocket 14 to ensure that sufficient food is in that pocket. Passing along to the 126° position, the piston 20 has begun to be withdrawn and at 144°, the third or metering sweeper 36 is influencing the structure of the food in the container. This sweeper, as noted above, is shown in detail in FIG. 6.

The fourth and final sweeper 39 also has the cutout as shown in FIG. 6A and leaves an extra amount of food product in the pocket. Sweeper 39 is located at approximately 162°. At this point, the compression pistons are fully withdrawn and located well above the rotating table. Similarly, the metering piston has been positioned upwardly by about the 130° point so that about one-quarter of an inch of product is located between the sweepers and the rotating table. However, on the outer side of the pocket 14, because of the sweeper 36 and 39 configuration, an extra amount of product extends above the pocket. As the table continues to rotate, the metering piston 30 is withdrawn downwardly to the metered height at about the 216° position, prior to the helical sweeper 40.

As noted above, helical sweeper 40 rotates against the rotation of table 10, thereby serving two purposes. It gently moves around the vegetable or food product in the pocket 14 so that metered amount is placed therein. In addition, it serves to move food product which is excess of the pocket inwardly toward the center of the rotating table 10 so that it can pass around and be utilized in the next pass through the machine. Concurrently, the deflector 48 ensures that food is not thrown upwardly and outwardly of the helical sweeper 40 in its rotation, and further serves to act as an auger arrangement to cause the food to move inwardly toward the center of rotating table 10. Without the extra product left by sweepers 36 and 39, the pocket will not be full on the outside after passing helical sweeper 40.

Operation of this table can be gathered from the description set forth above. However, in clarification, the following points are to be understood. Previous inventions have used fingered brushes to accomplish what this device does with a helical sweeper. It has been found that with this helical sweeper, the resultant amount of food in pocket 14 will be slightly below the surface of the table 10 after it passes through the helical sweeper 40. Accordingly, the sweepers 36 and 39 have been designed with the cutout 38 to permit an additional amount of food to extend upwardly out of the pocket 14 before it passes into the helical sweeper 40. The helical sweeper 40 has been found to be much gentler than the fingered brushes used in previous machines.

By raising the product slightly above the surface of the table before it reaches the helical sweeper, slightly more than the final weight is provided at that time. By dropping the metering piston just slightly, that additional product continues through the device and is gently massaged into the pocket by the helical sweeper 40.

The angle of the helical sweeper 40 is adjustable. It has been found that it can vary with the food being packed. However, the helical sweeper itself should be at an angle to a radius extending outwardly from the center of rotating table 10.

Food product is positioned on the rotating table 10 which forms a portion of the overall machine. The primary pocket and turret assembly including table 10 rotates in a counterclockwise direction. Various sweepers position the food into pockets 14 as the table rotates. Sweepers 36 and 39 are particularly important in that they provide a slightly higher amount of food on the outward side of the pocket passing thereunder so that as the table rotates under the sweeper 40, the sweeper 40, which rotates in a direction opposite from the rotation of the table, "levels" off the top of the food extending outwardly of pocket 14, so that a proper metered amount, both by volume and weight, is ensured to be in the pocket. When the food is withdrawn into the cup 16 located below the pocket, and as the table continues to rotate, the cups 16 pass outwardly from under the table 10 and are pushed through the enclosed bridge structure 18 and on to the can filling mechanism, which is not shown or discussed herein. A plate 60 serves to prevent food product from dropping through the open-ended pockets 14, while cups 16 are in the bridge structure 18 away from the primary pocket turret assembly or turntable 10. The cups 16 return to be underneath the table 10, again through the bridge structure 18, approximately 90° around the table and just prior to the point where new food is positioned on the table. As the table rotates, the food is compressed by the compression cylinder 20 while it is metered by the metering cylinder 24 located below the table and moving upwardly into the pocket 14. Thus, the result is a properly metered and measured amount of product in each of the pockets as it rotates about the table.

What is claimed is:

1. A metering and packing system for a food canning machine, the food canning machine including a horizontally mounted and rotatable turntable having a plurality of pockets and a plurality of open-ended cups located below the turntable, said pockets and said open-ended cups are rotatable with said turntable, each pocket having an opening at both the top and the bottom and adapted to communicate with the open-ended cup located therebelow, said pockets axially aligned with said cups, the system comprising:

a plurality of compression pistons mounted on said machine above said turntable pockets and rotatable therewith;

a plurality of metering pistons mounted on said machine below said turntable pockets and rotatable therewith;

said compression pistons movable inwardly and outwardly of said pockets;

said metering pistons movable through said open-ended cups and at least into said pockets;

feed means mounted on said machine above said turntable for introducing food to said turntable;

sweeper means mounted on said machine above said turntable for directing food on said turntable into said pockets;

bladed helical sweeper means mounted on said machine above said turntable for moving food across the top opening of said pockets;

means to move said compression pistons and said metering pistons toward each other whereby said food contained in said pockets is compressed;

means to move said compression pistons upwardly and outwardly of said pockets and to move said metering pistons into said pockets through the bottom opening thereof so that said compressed food extends outwardly through the top opening of said pocket; and, drive means to rotate said bladed helical sweeper means after said metering pistons move said food outwardly through said top opening of said pockets.

2. A method of packing food in cylindrical cans comprising the steps of:

1) providing food to a circular turntable having a plurality of pockets therein;

2) sweeping said food into said pockets;

3) compressing said food into said pockets by means of inwardly extending pistons moving into the upper and lower openings thereof;

4) rotating a bladed helical sweeper across the surface of said circular turntable in the vicinity of said filled pockets in order to meter the food into the pockets and move excess food toward the center of the turntable;

5) packaging said food in said pockets into cylindrical cans.

3. The method of claim 2 further including a step of forcing compressed food upwardly and outwardly of the pocket after step 3, but before step 4.

4. In a machine for filling cans of food, the machine having a horizontal turntable, having an upper surface and having a plurality of pockets around the perimeter thereof, a bladed helical sweeper comprising:

a rotatable cylinder body having an axis substantially parallel to the upper surface of said turntable, said cylinder body rotatable about said axis, said axis at a predetermined angle to a line parallel to a radius of said turntable and displaced therefrom so that said line passes through said axis;

a plurality of sweeper blades arranged around the periphery of said rotatable cylinder body, each sweeper blade attached to said cylinder body in a helical pattern;

said rotatable cylinder body mountable adjacent and above said turntable such that with said turntable rotating said cylinder body can also be rotated and said sweeper blades will sweep across said pockets to move food and fill said pockets.

5. The bladed helical sweeper of claim 4 wherein said sweeper blades extend around said cylinder body for ninety degrees.

6. The bladed helical sweeper of claim 4 further including a deflector located adjacent said bladed helical sweeper and having a cylindrical concave surface adjacent said bladed helical sweeper.

7. The metering and packing system of claim 1 wherein the bladed helical sweeper means includes:

a rotatable cylinder body having an axis substantially parallel to the upper surface of said turntable, said cylinder body rotatable about said axis, said axis at a predetermined angle to a line parallel to a radius of said turntable and displaced therefrom so that said line passes through said axis;

a plurality of sweeper blades arranged around the periphery of said rotatable cylinder body, each sweeper blade attached to said cylinder body in a helical pattern;

said rotatable cylinder body mountable adjacent and above said turntable such that with said turntable rotating said cylinder body can also be rotated and said sweeper blades will sweep across said pockets to move food and fill said pockets.

8. The metering and packing system of claim 7 further including a deflector located adjacent said bladed helical sweeper and having a cylindrical concave surface adjacent said bladed helical sweeper.

* * * * *